US005673165A

United States Patent [19]

Kühn et al.

[11] Patent Number: 5,673,165

[45] Date of Patent: Sep. 30, 1997

[54] CIRCUIT ARRANGEMENT FOR CONTROLLING THE ELECTROMAGNETIC DRIVE OF A SWITCHING DEVICE

[75] Inventors: Olaf Kühn, Dresden; Thomas Roschke, Kamenz, both of Germany

[73] Assignee: AEG Niederspannungstechnik GmbH, Neumuenster, Germany

[21] Appl. No.: 516,620

[22] Filed: Aug. 18, 1995

[30] Foreign Application Priority Data

Aug. 31, 1994 [DE] Germany ..... 44 30 867.1

[51] Int. Cl.[6] ..... H01H 47/22

[52] U.S. Cl. ..... 361/154; 361/160; 361/242

[58] Field of Search ..... 361/239, 242, 361/152, 154, 160, 170; 307/120; 324/420, 423; 340/644

[56] References Cited

U.S. PATENT DOCUMENTS

| | | | |
|---|---|---|---|
| 3,628,102 | 12/1971 | Jauch et al. | 361/170 |
| 4,538,930 | 9/1985 | Dunfield | 361/152 |
| 4,833,565 | 5/1989 | Bauer et al. | 361/154 |
| 4,949,215 | 8/1990 | Studtmann et al. | 361/154 |
| 5,028,856 | 7/1991 | Zannis . | |
| 5,313,153 | 5/1994 | Locher et al. . | |
| 5,481,187 | 1/1996 | Marcott et al. . | |

FOREIGN PATENT DOCUMENTS

| | | |
|---|---|---|
| 0376493A1 | 7/1990 | European Pat. Off. . |
| 40 20 094 | 1/1992 | Germany . |
| 40 24 496 | 2/1992 | Germany . |
| 40 31 427 | 4/1992 | Germany . |
| A-2127186 | 4/1984 | United Kingdom . |

OTHER PUBLICATIONS

Patent Abstracts of Japan, vol. 004, No. 075, May 31, 1980 & JP–A–55 043948 (NEC Corp), Mar. 28, 1980.

Patent Abstracts of Japan, vol. 007, No. 284, Dec. 17, 1983 & JP–A–58 161305 (Matsushita Denki Sangyo KK) Sep. 24, 1983.

Löffler, Dipl.–Ing. Horst, "Lineare Positionierantriebe" Magnetmotor und Linearmotor im Vergleich, *Elektronik* 15/1992, pp. 48–54.

Izadinia, Mansour et al, "H–Brücke aus einem Guß" Motor–Treiberbaustein vereinight CMOS, Bipolar und DMOS *Elektronik* 7/31 Mar. 1989, pp. 123–128.

Xander, Prof. Dipl.–Ing. Karl, "Regelungstechnik mit elektronischen Bauelementen", Werner–Ingenieur–Texte 6, Werner–Verlag, 1981, pp. 198–201.

*Primary Examiner*—Fritz Fleming
*Attorney, Agent, or Firm*—Spencer & Frank

[57] ABSTRACT

A reduction in contact bounce in an electromagnetic switch is accomplished by optimizing armature speed over its travel path with a circuit arrangement for controlling a drive current in the coil of the electromagnetic switch. A superposed speed loop including a speed sensor produces a measured voltage in response to speed of the armature. A converter coupled to the speed sensor converts the measured voltage into a value corresponding to an actual speed of the armature. A first summer receives a constant reference value corresponding to a desired speed for the armature and the value corresponding to the actual speed of the armature, and produces a difference voltage corresponding to a difference between the desired speed and the actual speed of the armature. A proportional element amplifies the difference voltage and produces a desired current value corresponding to the amplified difference voltage. An underlying current control loop including a current sensor produces a measured current value corresponding to a current in the coil. A second summer receiving the measured current value and the desired current value produces an output current corresponding to a difference between the desired current value and the measured current value. A chopper coupled to the output current of the second summer operates with hysteresis for conducting a pulsed control voltage to the coil and is interrupted from doing so when the measured current value is greater than the desired current value plus an hysteresis value.

14 Claims, 5 Drawing Sheets

CIRCUIT ARRANGEMENT FOR CONTROLLING THE ELECTROMAGNETIC DRIVE OF A SWITCHING DEVICE

CROSS-REFERENCE TO RELATED APPLICATIONS

This application claims priority with respect to application No. P 44 30 867.1 filed in Germany on Aug. 31, 1994, the disclosure of which is incorporated herein by reference.

BACKGROUND OF THE INVENTION

The invention relates to an electromagnetic switching device, such as a contactor, solenoid, or relay, in which an armature moves in response to a drive current in a coil and in particular to a circuit arrangement for controlling the drive current in the coil for reducing contact bounce of a contact member attached to the armature.

Electromagnetic switching devices are used in automation and drive technology, where they serve, for example, as relays which in cooperation with other components to ensure safe control of different electrical devices. For optimum adaptation of these switching devices to their switching task, while taking into consideration different operating conditions and specific device characteristics, it can be desirable to adhere to a predetermined speed/distance profile of the contact movement. In this way, special switching principles can be applied so that the contact bounce at the time of actuation can be minimized. This leads to a reduction in burn-up and mechanical wear of the contact, which can be translated into an increase in service life and/or maximum switching capability of the device. The more successfully the necessary ideal course of the speed of the switching device is assured over the course of the contact travel, the less wear takes place and the better the adaptation of the device to the switching task. This type of speed/distance profile for reducing bounce can essentially be attributed an optimum speed during the making of contact and a reduction in speed when the core halves impact. This optimum speed during the making of contact is usually smaller than the speed of the uncontrolled switching device, which varies in a wide range. The increase of the contact travel up to the making of contact due to burn-up is a particular hindrance, because the ideal course of the speed/distance characteristic curve is consequently changed over the service life of the switching device.

A reduction in bounce can partially be accomplished by a better matchup between the contact, transmission and drive systems of the switching device. This matchup is only possible for certain conditions, mostly nominal or rated operating conditions, but not for the whole range of allowed conditions. In contrast, maintaining a certain speed/distance profile assures a reduction of bounce under all acceptable conditions of use over the entire service life of the switching device, with the consideration of the manufacturing tolerances of the device. The effective maintenance of this ideal curve can be realized by circuit arrangements that are suitable for controlling the course of movement.

European patent application No. EP 0 376 493 A1 discloses a control circuit with which the movement process of electromagnetic relays is influenced in order to reduce the incidence of bounce. In this case, a very high current is permitted in the first phase of movement for the purpose of rapid acceleration. Before the relay is closed, the current is reduced to a relatively small value, and the speed of movement of the armature/contact correspondingly assumes a smaller value, which leads to reduced bouncing.

The objective of the known circuit arrangements for electronic switching drives is to reduce armature speed, without a special contact-making speed optimized to minimum bounce being achieved at the same time. Further, only fluctuations in the control voltage and, to a certain extent, the temperature, are compensated or taken into consideration. Likewise, disturbances of desired armature motion such as burn-up, friction and tolerances are not considered.

SUMMARY OF THE INVENTION

It is an object of the present invention to provide a circuit arrangement for controlling the drive of an electromagnetic switching device, by means of which the maintenance of optimum contact-making speeds and the limitation of the armature core impact speed are assured, with the simplest means, over the entire service life of the switching device, and in spite of disturbances caused by burn-up, friction and tolerance the permissible ranges for control voltage and temperature are even expanded, and greater tolerances can be permitted.

The above and other objects are accomplished according to the invention by the provision of a circuit arrangement for controlling a drive current in a coil of an electromagnetic switching device having an armature that moves in dependence of the drive current, including: a superposed speed loop including a speed sensor for producing a measured voltage in response to speed of the armature; a converter coupled to the speed sensor for converting the measured voltage into a value corresponding to an actual speed of the armature; a first summer receiving a constant reference value corresponding to a desired speed for the armature and the value corresponding to the actual speed of armature, and producing a difference voltage corresponding to a difference between the actual speed and the desired speed of the armature; a proportional element for amplifying the difference voltage and producing a desired current value corresponding to the amplified difference voltage; an underlying current control loop including a current sensor for producing a measured current value corresponding to an actual current in the coil; a second summer receiving the measured current value and the desired current value and producing an output current corresponding to a difference between the desired current value and the measured current value; and a chopper, operating with hysteresis, coupled to the output current of the second summer for conducting a pulsed control voltage to the coil when the measured current value is greater than the desired current value plus an hysteresis value.

The circuit arrangement of the invention can be used in electromagnetic switching devices that are operated both with direct and alternating current. Furthermore, their effectiveness is independent of the turn-on phase position of the control voltage, and the switching process begins without delay initiated by a control circuit, so the closing delay time is scarcely increased compared to a non-controlled switching device.

The circuit arrangement is distinguished by a simple design, which does not require a memory for desired curves or a microcontroller for controlling the drive. The use of a simple speed sensor also permits suppression of the influence of disturbances such as fluctuations of control voltage, burn-up of the contacts, temperature, friction and/or assembly and manufacturing tolerances, within a wide range.

Further advantageous embodiments and features of the invention will become apparent from the following detailed description and the accompanying drawings.

DETAILED DESCRIPTION OF THE PREFERRED EMBODIMENT

Figure 1:
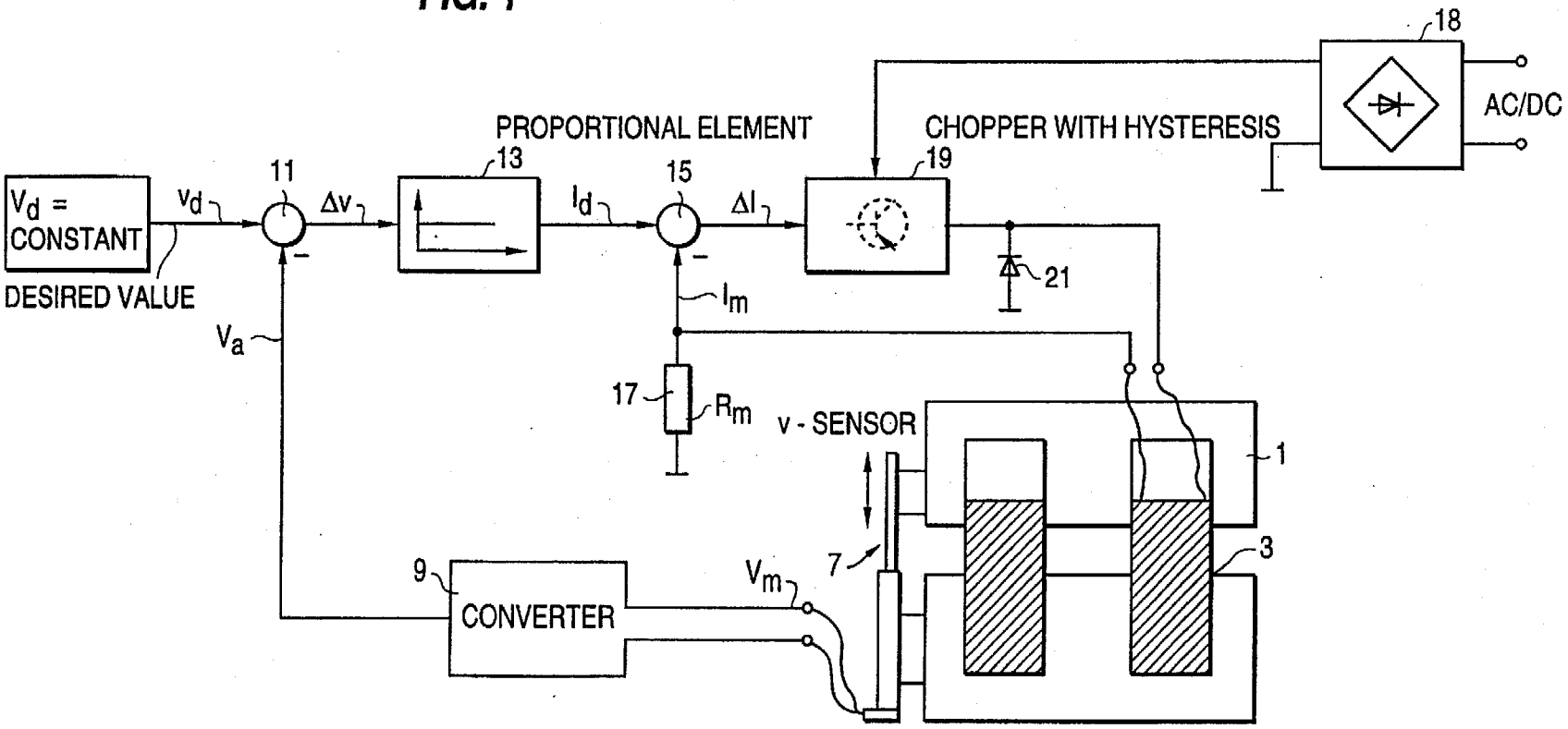
FIG. 1 is a block diagram of a circuit arrangement according to the invention for controlling the drive current, and thus the armature speed, of an electromagnetic switching device.

Referring to FIG. 1, there is shown a block diagram of a circuit arrangement for controlling the movement of an armature 1 in an electromagnetic switching device, not shown in detail, particularly in a contactor, solenoid, or relay having a coil 3, which is connected to a chopper 19 for generating pulsed control voltages. A superposed speed loop is provided which includes a speed sensor 7 that measures the speed of armature 1 and supplies a measuring voltage $V_m$ proportional to speed to a converter 9. Speed sensor 7 can have a variety of configurations, for example, it can be inductive or optical, as will be appreciated by those skilled in the art. The measurement voltage from sensor 7 is converted in converter 9 into voltage a $V_a$ value that corresponds to actual speed of the armature, and is fed to a summing device 11 for determining a difference between the actual armature speed $V_a$ and a desired speed value $v_d$ fed to the positive input of summing device 11 as a constant reference value.

This desired speed value $v_d$ is a desired value that remains constant during the entire control process. Its value corresponds approximately to the desired armature speed at a time that contact is made.

An output signal from summing device 11 that corresponds to a difference voltage $\Delta v$ is then conducted to a proportional element 13 for conversion and amplification in order to form a desired current value $I_d$. The signals of the desired current value $I_d$ and a measured current value $I_m$ in coil 3 are fed to a summing device 15, in which the difference current $\Delta I$ between the desired current value $I_d$ and the measured current value $I_m$ is determined. The measured current value $I_m$ results from the measured voltage determined, for example, by means of a measuring resistor 17.

With a positive current control deviation $\Delta I=I_d-I_m$, i.e., the desired value of the current is greater than the measured current value, chopper 19 is closed and a rectified supply voltage is conducted from a full-wave rectifier 18 to coil 3.

With a negative control deviation $\Delta I$, the operation of chopper 19 is interrupted, and the coil current then flows via the measuring resistor 17 and a free-wheeling circuit having a free-wheeling diode 21 as better illustrated in FIG. 2 discussed below. Thus, the current in the coil 3 is maintained up to the next turn-on pulse of the chopper 19. The full-wave rectifier 18 can be charged with direct or alternating current.

In an advantageous embodiment, chopper 19 operates with hysteresis. For this purpose, chopper 19 does not interrupt the circuit until the measured current value $I_m$ lies above a desired value by a fixed hysteresis value $I_{Hysteresis}$. The underlying current control loop can be used in connection with chopper 19 operating with hysteresis for holding pulses after the pick-up process in that a fixed holding current limiting value is fed to the summing device 15. Switching from derived current value $I_d$ to such a constant holding current is advantageously carried out by means of a constant time element for the change-over-time whose time constant is clearly greater than the maximum possible total closing time.

In accordance with the invention, a superposed speed-control loop and a dynamically faster, underlying current-control loop form a circuit arrangement for an electromagnetic switching device, with which a reduction in contact bounce and thus a reduction in burn-up is accomplished by an optimum contact-making speed and a limited armature core impact speed. This lengthens the service life of the switching device and/or increases switching capability, while the speeds under the influence of fluctuations in control voltage, permissible ambient temperatures, tolerances, contact burn-up and friction are held relatively constant for the duration of use.

Figure 2:
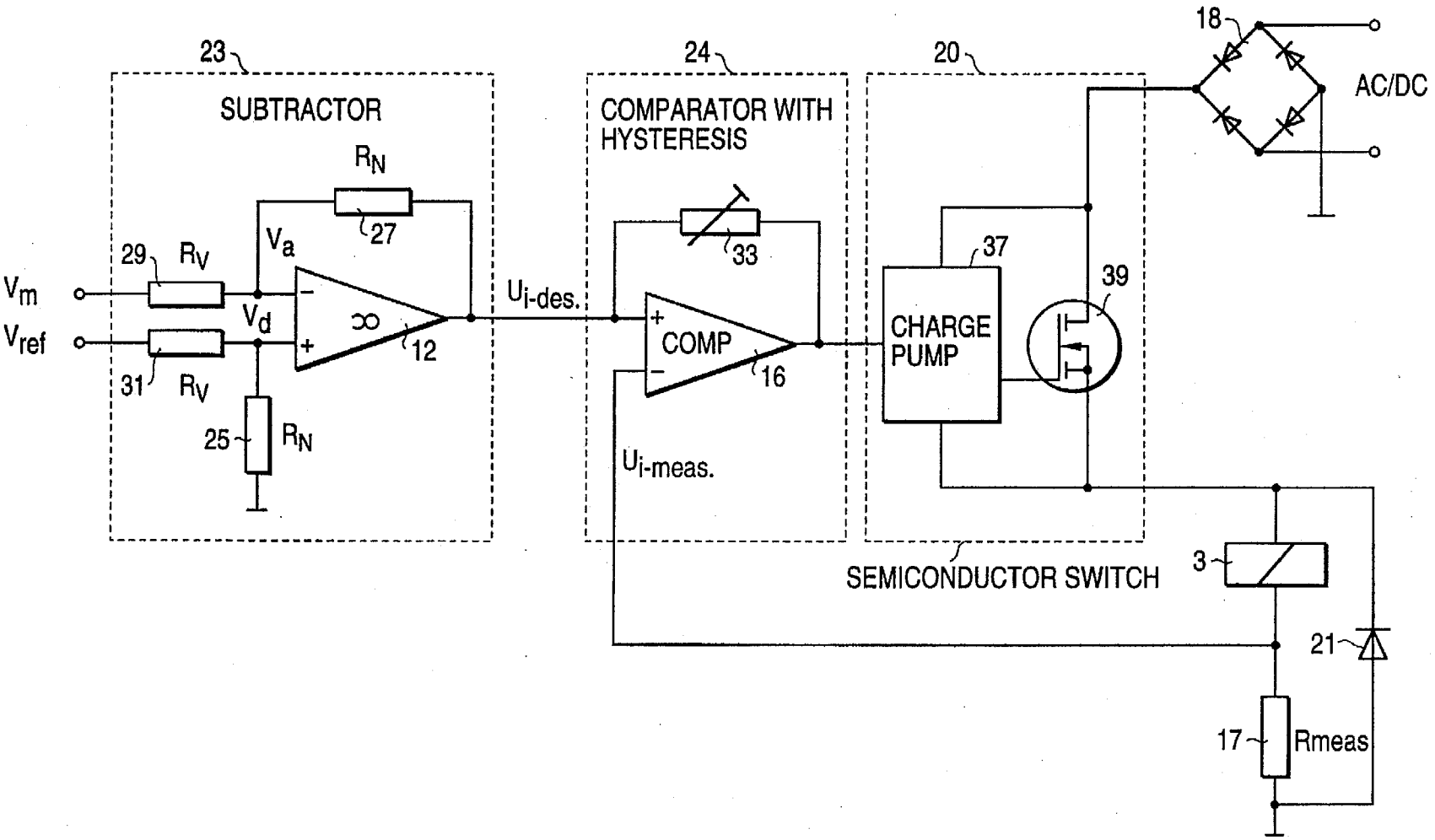
FIG. 2 is a circuit schematic for implementing the arrangement of FIG. 1.

FIG. 2 shows a circuit schematic for implementing the block diagram in FIG. 1. A subtracter 23 is provided that forms a difference between the desired speed value $V_d$ and the actual speed value $V_a$ resulting from the measured speed $V_m$ measured with speed sensor 7 according to FIG. 1. The desired speed value is proportional to a reference voltage value $V_{Ref}$ which remains constant. The speed difference is amplified in an operational amplifier 12 by the resistance ratio $R_N/R_V$ of resistors 25, 27, 29, 31, so that the desired value $U_{i\text{-}des}$ for the current is present at the output of subtracter 23. A possibly necessary calibration factor of the speed sensor can also be considered in the amplification of subtracter 23. The desired value of the current is fed to a comparator 16 as a reference or threshold value. As long as the measured value of the current $U_{i\text{-}means}$ is less than the reference value, a high potential is present at the output of comparator 16. An n-channel power MOSFET 39 is controlled by a charge pump 37 for conducting current from full-bridge rectifier 18 to coil 3. As soon as the measured value $U_{i\text{-}mess}$ becomes greater than the reference value $U_{i\text{-}des}$ plus a switching hysteresis that can be adjusted by means of a resistor 33 connected in parallel by way of the comparator 16, a low potential is present at the output of the comparator 16, and the semiconductor switch 20 is blocked. The current of the coil 3 then flows via the free-wheeling diode 21. The semiconductor switch 20 can also comprise a p-channel power MOSFET.

Figure 3A:
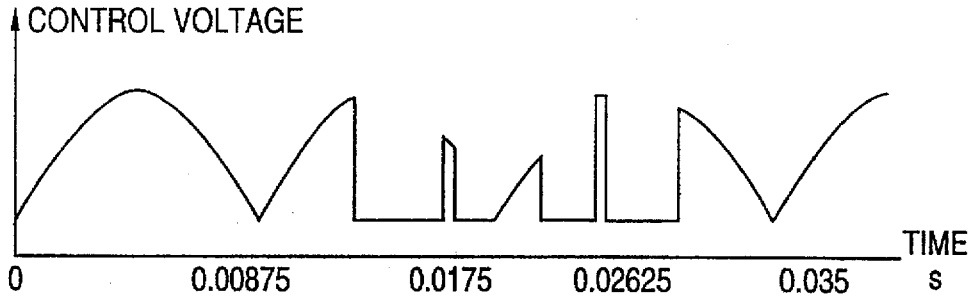
FIGS. 3a–3c are diagrams showing control voltage, speed and current curves, respectively, for explaining operation of the invention.
Figure 3B:
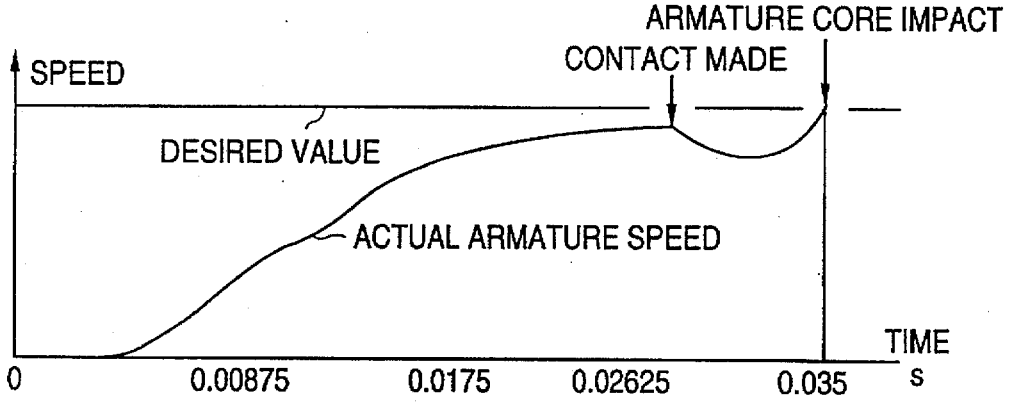
Figure 3C:
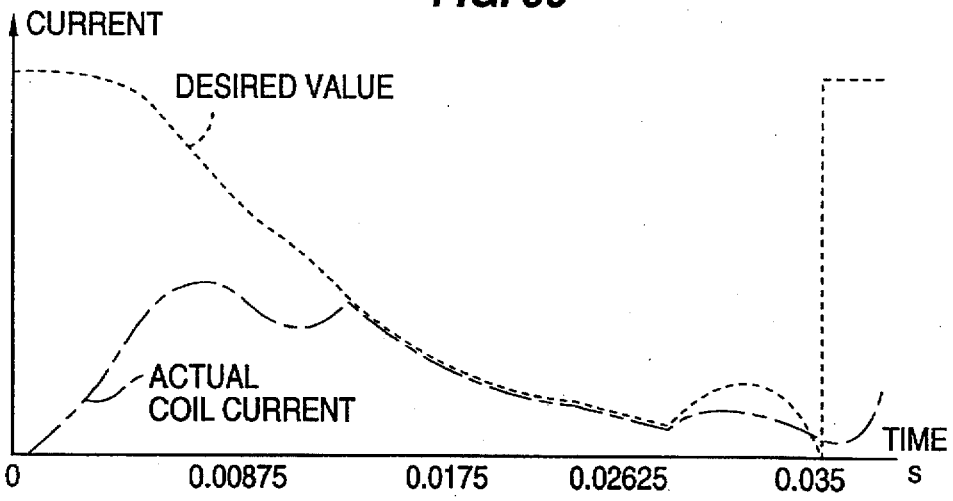

FIGS. 3a–3c illustrate a pick-up process controlled in accordance with the invention, in which the time units are the same in each figure. FIG. 3a shows the temporal course of the pulsed control voltage, wherein the control voltage is a rectified AC voltage which is controllably interrupted by semiconductor switch 20 in accordance with the invention. FIG. 3b shows the constant desired value for speed and the actual value for speed during the pick-up process. The times at which contact is made and of impact of armature cores, as the core halves are closed, are shown. The desired and measured values for the current are illustrated in FIG. 3c. The desired value of the current results from the difference between the desired and actual speed, which can be seen in FIG. 3b, and is amplified by a factor K. Only when the speed of the armature approximates its desired value, and the speed difference is thus small enough, is the control supply voltage shut off by the chopper 19. Up to this point, the available energy is consumed completely in order to accelerate the armature. Consequently, an advantage of the circuit arrangement of the invention is the shortest possible pick-up times and, as a function of the switching hysteresis, only a few switching cycles. This low switching frequency leads to good EMC (Electromagnetic Compatibility) properties and a lower stress on the semiconductor components.

Figure 4:
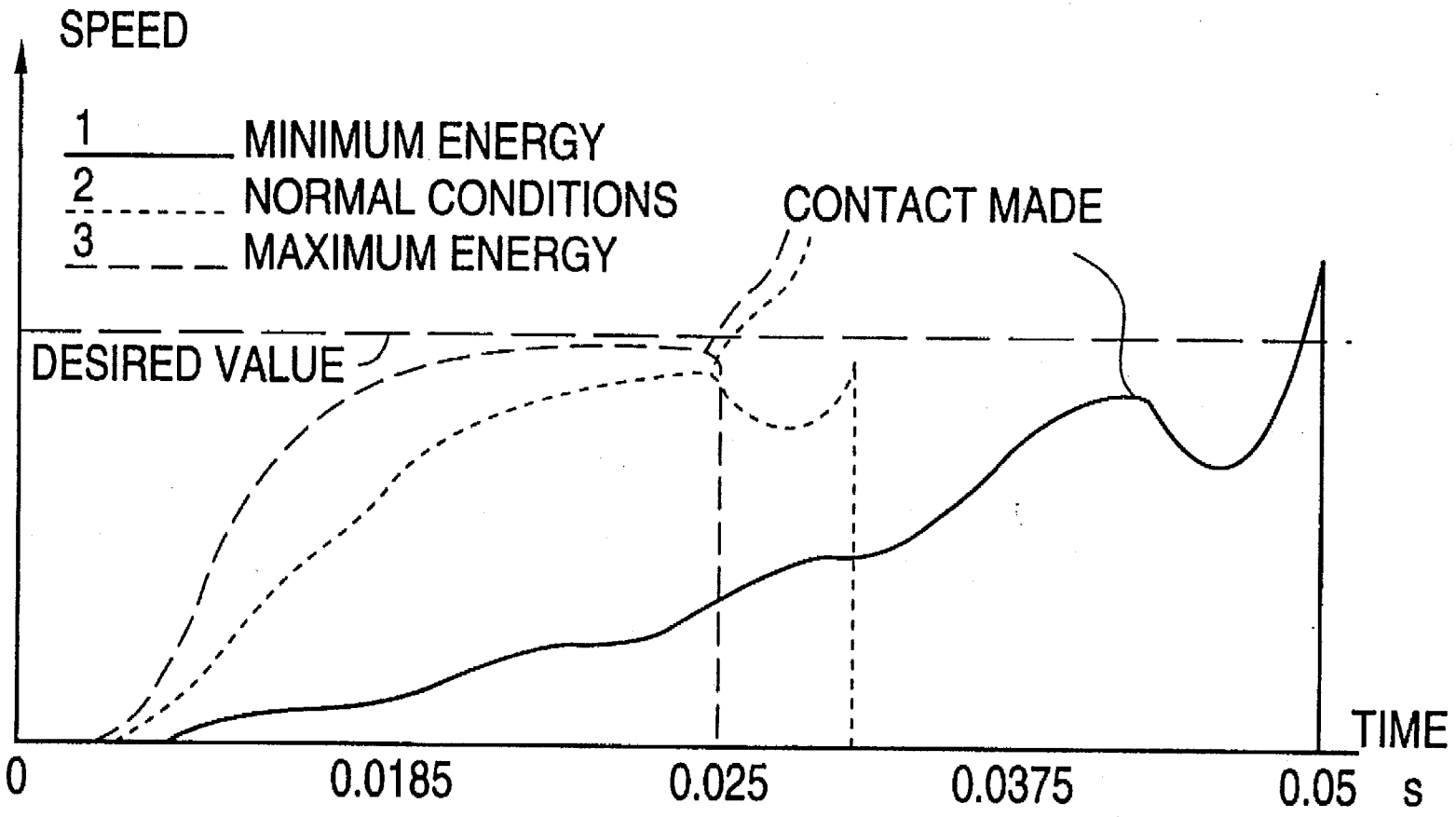
FIG. 4 is a diagram which shows speed curves under different operating conditions.

FIG. 4 illustrates three speed curves of the armature under special conditions. The dashed line 3 shows the worst case at maximum excess energy, where the highest control voltage, the lowest temperature, the least friction, the least load spring force and the smallest air gap during the making of contact at maximum burn-up are present. The opposite extreme case, at minimum energy for pick-up, is represented by the solid line 1. The speed curve under normal conditions (when the device is new and operating under nominal conditions) is represented by the dotted line 2. The more excess energy that is available, the sooner the pick-up process is completed. The speeds, particularly at the time contact is made, deviate only slightly from one another because of the circuit arrangement according to the invention.

In a modification of the foregoing, the superposed speed control loop and the underlying current control loop may be realized, in part, by algorithms in a microprocessor.

Figure 5:
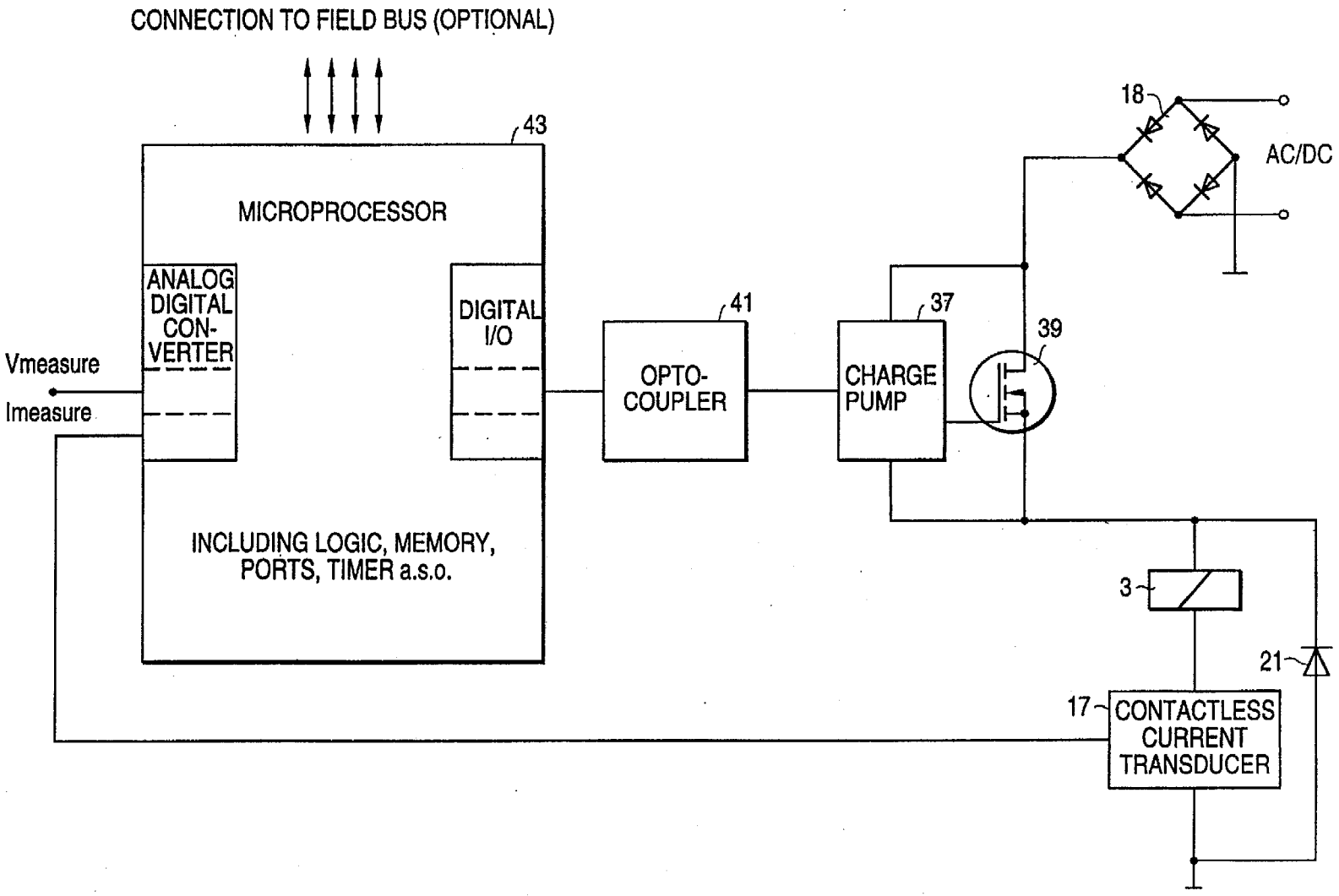
FIG. 5 is a block diagram for implementing the arrangement of FIG. 1 using a microprocessor.

FIG. 5 shows a microprocessor 43 with at least two analog-digital-converters for measured speed $V_{measure}$ and measured current $I_{measure}$. The current through the coil is measured by a contactless current transducer 17. The function of the superposed speed-control-loop and the underlying current-control-loop are converted into algorithms. A digital output of the microprocessor charges an optocoupler 41 which controls the semiconductor switch. This switch is for example carried out as an charge pump 37 and a n-channel power MOSFET 39.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A circuit arrangement for controlling a drive current in a coil of an electromagnetic switching device having an armature that moves in dependence of the drive current, comprising:

a superposed speed loop including a speed sensor for producing a measured voltage in response to speed of the armature;

a converter coupled to the speed sensor for converting the measured voltage into a value corresponding to an actual speed of the armature;

a first summer receiving a constant reference value corresponding to a desired speed for the armature and the value corresponding to the actual speed of armature, and producing a difference voltage corresponding to a difference between the desired speed and the actual speed of the armature;

a proportional element for amplifying the difference voltage and producing a desired current value corresponding to the amplified difference voltage;

an underlying current control loop including a current sensor for producing a measured current value corresponding to a current in the coil;

a second summer receiving the measured current value and the desired current value and producing an output current corresponding to a difference between the desired current value and the measured current value; and a chopper, operating with hysteresis, coupled to the output current of the second summer for conducting a pulsed control voltage to the coil, the chopper being interrupted when the measured current value is greater than the desired current value plus an hysteresis value.

2. The circuit arrangement as defined in claim 1, and further comprising a free-wheeling diode connected in electrical parallel with the coil so that the chopper is conducting current to the coil when the measured current value is less than the desired current value and connected in electrical series with the coil when the chopper is interrupted so that current flows in the coil via the free-wheeling diode.

3. The circuit arrangement as defined in claim 2, further comprising a full-wave rectifier charged with direct or alternating current disposed upstream of the chopper in a load circuit with the coil.

4. The circuit arrangement as defined in claim 1, wherein the first summer, converter and proportional element are embodied in an operational amplifier wired as a subtracter and having a positive input coupled to a reference voltage corresponding to the desired speed and a negative input coupled to the measured voltage of the speed sensor, the operational amplifier having input and feedback resistors arranged for converting the measured voltage to the actual speed value and for causing the operational amplifier to amplify the difference voltage and producing the desired current value.

5. The circuit arrangement as defined claim 1, wherein the current sensor comprises a current-measuring resistor, the chopper comprises a semiconductor switch, the second summer comprises a comparator having positive and negative inputs, an output and an adjustment resistor connected between the output and the positive input of the comparator, the hysteresis of the chopper being adjusted by adjustment of the adjusting resistor, the positive input of the comparator being coupled to the desired current value, the negative input of the comparator being coupled to the measured current value of the current-measuring resistor, and the comparator having a low/high output signal which is fed to the semiconductor switch.

6. The circuit arrangement as defined in claim 5, wherein the semiconductor switch comprises a p-channel power MOSFET.

7. The circuit arrangement as defined in claim 5, wherein the semiconductor switch comprises an n-channel power MOSFET and a charge pump for actuating the MOSFET.

8. The circuit arrangement as defined in claim 1, wherein the superposed speed control loop and the underlying current control loop are realized, in part, by algorithms in a microprocessor.

9. A circuit arrangement for controlling a drive current in a coil of an electromagnetic switching device having an armature that moves in dependence of the drive current, comprising:

a speed sensor coupled to the armature for producing a measured voltage value corresponding to actual speed of the armature;

a first summer receiving a constant reference value corresponding to a desired speed for the armature and the measured voltage value and producing a difference voltage corresponding to a difference between the desired speed and the actual speed of the armature;

a proportional element for amplifying the difference voltage and producing a desired current value corresponding to the amplified difference voltage;

a current sensor for producing a measured current value corresponding to a current in the coil;

a second summer receiving the measured current value and the desired current value and producing an output current corresponding to a difference between the desired current value and the measured current value, the output current having a first state when the desired current value is greater than the measured current value and a second state when the measured current is greater than the desired current;

a chopper coupled to the output current of the second summer for conducting said current to the coil when the output current is in the first state and the chopper being interrupted when the output current is in the second state.

10. The circuit arrangement as defined in claim 9, further comprising a free-wheeling diode connected in electrical parallel with the coil and electrical series with the chopper and being back biased when the output current is in the first state for controlling the chopper to conduct current to the coil, the free-wheeling diode being connected in electrical series with the coil and being forward biased for conducting current of the coil when the output current is in the second state and interrupts the chopper.

11. The circuit arrangement as defined claim 9, wherein the current sensor comprises a current-measuring resistor connected to the coil.

12. The circuit arrangement as defined claim 9, wherein the chopper comprises a semiconductor switch.

13. The circuit arrangement as defined claim 9, wherein the output current is switched to the first state when the desired current value is greater that the measured current and is switched to the second state when the measured current is greater than the desired current plus a hysteresis value.

14. The circuit arrangement as defined in claim 13, wherein the second summer comprises a comparator having positive and negative inputs, an output and an adjustment resistor connected between the output and the positive input of the comparator for adjusting the hysteresis value, the positive input of the comparator being coupled to the desired current value, the negative input of the comparator being coupled to the measured current value of the current-measuring resistor.

* * * * *